US008256845B2

(12) United States Patent
Wang

(10) Patent No.: US 8,256,845 B2
(45) Date of Patent: Sep. 4, 2012

(54) BAMBOO CHAIR

(76) Inventor: Wen-Tsan Wang, Taipei (TW)

( * ) Notice: Subject to any disclaimer, the term of this patent is extended or adjusted under 35 U.S.C. 154(b) by 169 days.

(21) Appl. No.: 12/892,886

(22) Filed: Sep. 28, 2010

(65) Prior Publication Data

US 2012/0074754 A1 Mar. 29, 2012

(51) Int. Cl.
*A47C 7/02* (2006.01)

(52) U.S. Cl. ..... 297/446.1; 297/447.4; 297/448.2; 297/449.1; 297/451.3; 297/451.8; 297/452.63

(58) Field of Classification Search ..... 297/446.1, 297/447.4, 448.2, 449.1, 452.63, 451.3, 451.8
See application file for complete search history.

(56) References Cited

U.S. PATENT DOCUMENTS 2,649,147 A * 8/1953 Sanford ..... 297/448.2 X
4,235,473 A * 11/1980 Aginar ..... 297/452.63 X
4,703,976 A * 11/1987 Wirth ..... 297/446.1
5,284,380 A * 2/1994 Gehry ..... 297/451.9
6,003,948 A * 12/1999 Holbrook ..... 297/446.1 X
7,380,879 B2 * 6/2008 Fletcher et al. ..... 297/448.2 X
7,552,975 B2 * 6/2009 Maier et al. ..... 297/448.2
8,147,002 B2 * 4/2012 Chen et al. ..... 297/452.63
2003/0227210 A1 * 12/2003 Bosman et al. ..... 297/446.1 X
2009/0140568 A1 * 6/2009 Chan et al. ..... 297/452.63 X

* cited by examiner

*Primary Examiner* — Rodney B White
(74) *Attorney, Agent, or Firm* — Leong C. Lei

(57) ABSTRACT

A bamboo chair includes L-shaped first bamboo strips arranged in parallel, L-shaped third bamboo strips arranged in parallel, first reinforcing members fixedly connected between the straight horizontal sides of the L-shaped third bamboo strips and the straight horizontal sides of the L-shaped first bamboo strips in a parallel manner, a second reinforcing member fixedly connected between the arched vertical sides of the L-shaped first bamboo strips and the arched vertical sides of the L-shaped first bamboo strips at the bottom side, L-shaped second bamboo strips arranged in parallel and supported between the arched vertical sides of the L-shaped first bamboo strips and the arched vertical sides of the L-shaped third bamboo strips, and third reinforcing members respectively fixedly connected between the arched vertical sides of the L-shaped third bamboo strips and the straight horizontal sides of the L-shaped second bamboo strips and between the arched vertical sides of the L-shaped second bamboo strips and the arched vertical sides of the L-shaped first bamboo strips.

4 Claims, 5 Drawing Sheets

BAMBOO CHAIR

BACKGROUND OF THE INVENTION a) Field of the Invention

The present invention relates to furniture and more particularly, to a bamboo chair, which is made of curved bamboo strips and straight bamboo slats in a human-body friendly design.

b) Description of the Prior Art

Many different materials, such as wood, plastics, metal, leather and etc. may be used for making different types of chairs. Except the function for use by one person to sit on, a delicate chair can also be used as a decoration item. Bamboo and wood chairs are highly invited by consumers for the advantage of antique beauty.

Chairs, made of any material, commonly have a base unit for positioning on the floor, a seat unit for the sitting of a person, and a support unit that support the seat unit on the base unit. Commercial bamboo chairs are commonly made of bamboo strips by weaving. These commercial bamboo chairs are less flexible, not comfortable for long sitting.

SUMMARY OF THE INVENTION

The present invention has been accomplished under the circumstances in view. It is one object of the present invention to provide a bamboo chair, which is a human-body friendly design, comfortable for long sitting.

According to the technical features of the present invention, curved first, second and third bamboo strips are fixedly fastened together with reinforcing members to constitute a base unit, a seat unit and a support unit. The curved first, second and third bamboo strips are respectively arranged in parallel. The reinforcing members are used to affix the curved first, second and third bamboo strips together. Thus, the finished bamboo chair has a high strength and is human-body friendly for long sitting comfortably.

In one embodiment of the present invention, the bamboo chair is a cantilever chair, comprising L-shaped first bamboo strips arranged in parallel, L-shaped third bamboo strips arranged in parallel, first reinforcing members fixedly connected between the straight horizontal sides of the L-shaped third bamboo strips and the straight horizontal sides of the L-shaped first bamboo strips in a parallel manner, a second reinforcing member fixedly connected between the arched vertical sides of the L-shaped first bamboo strips and the arched vertical sides of the L-shaped first bamboo strips at the bottom side, L-shaped second bamboo strips arranged in parallel and supported between the arched vertical sides of the L-shaped first bamboo strips and the arched vertical sides of the L-shaped third bamboo strips, and third reinforcing members respectively fixedly connected between the arched vertical sides of the L-shaped third bamboo strips and the straight horizontal sides of the L-shaped second bamboo strips and between the arched vertical sides of the L-shaped second bamboo strips and the arched vertical sides of the L-shaped first bamboo strips.

Thus, the first reinforcing members, the straight horizontal sides of the L-shaped third bamboo strips and the straight horizontal sides of the L-shaped first bamboo strips constitute the base unit for positioning on the floor; the second reinforcing member, the arched vertical sides of the L-shaped third bamboo strips and the arched vertical sides of the L-shaped first bamboo strips constitute a support unit; the third reinforcing members, the arched vertical sides of the L-shaped third bamboo strips and the straight horizontal sides of the L-shaped second bamboo strips constitute a seat unit supported on the support unit for the sitting of a person; the arched vertical sides of the L-shaped first bamboo strips and the arched vertical sides of the L-shaped third bamboo strips define a first open space; the arched vertical sides of the L-shaped third bamboo strips and the straight horizontal sides of the L-shaped second bamboo strips define a second open space in communication with the first open space for pressure buffering.

Further, two fourth bamboo strips are affixed to two L-shaped second bamboo strips at two opposite lateral sides for use as armrests for the resting of the two arms of a person sitting on said seat unit.

Further, each L-shaped first bamboo strip has a heel protruded from the bottom end of the arched vertical side adjacent to the straight horizontal side thereof for preventing the bamboo cantilever chair from backward falling.

In an alternate form of the present invention, the bamboo chair comprises a plurality of ⊓-shaped inner bamboo strips arranged in parallel, a plurality of ⊓-shaped outer bamboo strips arranged in parallel and respectively suspending above the ⊓-shaped inner bamboo strips, and a plurality of reinforcing straight bamboo slats fixedly mounted in between the ⊓-shaped inner bamboo strips and the ⊓-shaped outer bamboo strips and kept apart from one another.

DETAILED DESCRIPTION OF THE PREFERRED EMBODIMENT

Figure 2:
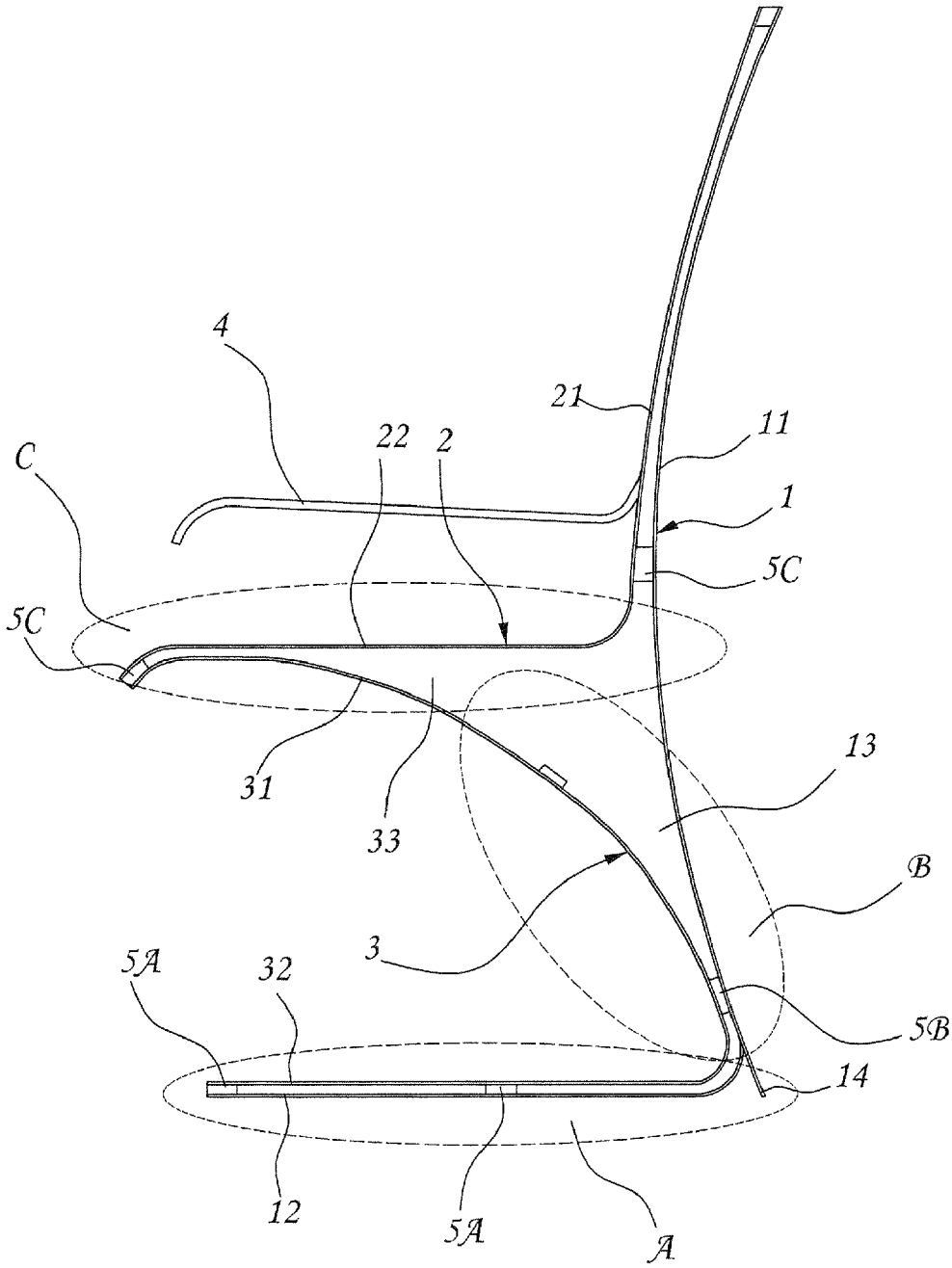
FIG. 2 is a side plain view of the bamboo cantilever chair shown in FIG. 1.
Figure 3:
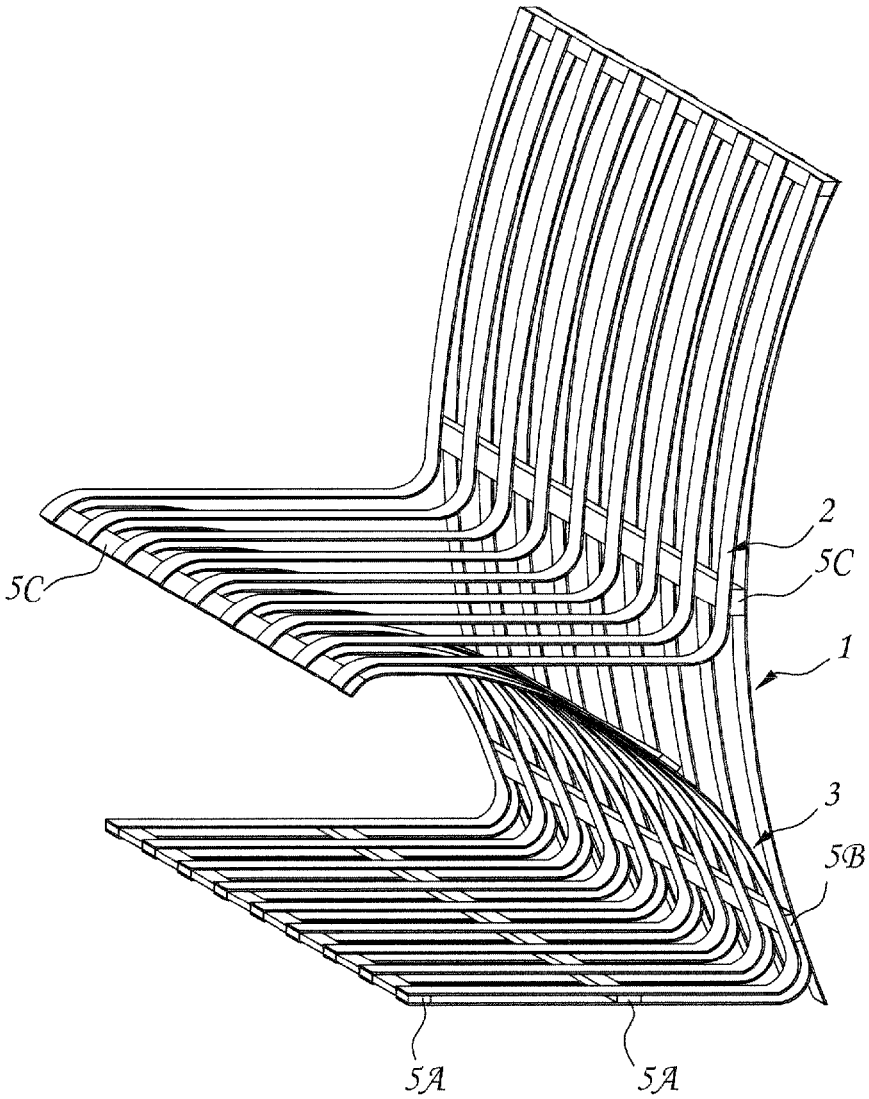
FIG. 3 is an oblique elevation of a bamboo cantilever chair without armrests in accordance with a second embodiment of the present invention.

Referring to FIGS. 2 and 3, a bamboo chair in accordance with a first embodiment of the present invention is a cantilever chair made by connecting first bamboo strips 1, second bamboo strips 2, third bamboo strips 3 and a plurality of first reinforcing members 5A, at least one, for example, one second reinforcing member 5B and a plurality of third reinforcing members 5C together to provide a base unit A, a support unit B and a seat unit C. The first bamboo strips 1, second bamboo strips 2, third bamboo strips 3 are flat, narrow, elongated bamboo strips respectively processed into a respective predetermined shape. The first bamboo strips 1 are L shaped, each having an arched vertical side 11, a straight horizontal side 12 perpendicularly extended from one end, namely, the bottom end of the arched vertical side 11 and a heel 14 protruded from the bottom end of the arched vertical side 11 adjacent to the straight horizontal side 12. The contained angle defined between the arched vertical side 11 and the straight horizontal side 12 is an acute angle. The second bamboo strips 2 are L shaped, each having an arched vertical side 21 and a straight horizontal side 22 perpendicularly extended from one end, namely, the bottom end of the arched vertical side 21. The contained angle defined between the arched vertical side 21 and the straight horizontal side 22 is an obtuse angle. The vertical height of the arched vertical side 21 of each second bamboo strip 2 is shorter than the vertical height of the arched vertical side 11 of each first bamboo strip 1. The third bamboo strips 3 are L shaped, each having an arched vertical side 31 and a straight horizontal side 32 perpendicularly extended from one end, namely, the bottom end of the arched vertical side 31. The contained angle defined between the arched vertical side 31 and the straight horizontal side 32 is an acute angle. The first reinforcing members 5A, the second reinforcing member 5B and the third reinforcing members 5C are narrow, elongated, straight bamboo slats.

During installation, set the first reinforcing members 5A in between the straight horizontal sides 32 of the third bamboo strips 3 and the straight horizontal sides 12 of the first bamboo strips 1 and then fixedly fasten the first reinforcing members 5A, the straight horizontal sides 32 of the third bamboo strips 3 and the straight horizontal sides 12 of the first bamboo strips 1 together, and then set the second reinforcing member 5B in between the arched vertical sides 31 of the third bamboo strips 3 and the arched vertical sides 11 of the first bamboo strips 1 and then fixedly fasten the second reinforcing member 5B, the arched vertical sides 31 of the third bamboo strips 3 and the arched vertical sides 11 of the first bamboo strips 1 together, and then set the third reinforcing members 5C in between the arched vertical sides 31 of the third bamboo strips 3 and the straight horizontal sides 22 of the second bamboo strips 2 and in between the arched vertical sides 21 of the second bamboo strips 2 and the arched vertical sides 11 of the first bamboo strips 1 and affix them together. Thus, the first reinforcing members 5A, the straight horizontal sides 32 of the third bamboo strips 3 and the straight horizontal sides 12 of the first bamboo strips 1 constitute the base unit A; the second reinforcing members 5B, the arched vertical sides 31 of the third bamboo strips 3 and the arched vertical sides 11 of the first bamboo strips 1 constitute the support unit B; the third reinforcing members 5C, the arched vertical sides 31 of the third bamboo strips 3 and the straight horizontal sides 22 of the second bamboo strips 2 constitute the seat unit C; the arched vertical sides 11 of the first bamboo strips 1, the arched vertical sides 31 of the third bamboo strips 3 define a first open space 13; the arched vertical sides 31 of the third bamboo strips 3 and the straight horizontal sides 22 of the second bamboo strips 2 define a second open space 23 in communication with the first open space 13 for pressure buffering. When the user is sitting on the bamboo cantilever chair, the heels 14 of the first bamboo strip 1 prohibit the bamboo cantilever chair from backward falling. The first bamboo strips 1, the second bamboo strips 2 and the third bamboo strips 3 are respectively arranged in parallel and secured together by means of the first reinforcing members 5A, the second reinforcing members 5B and the third reinforcing members 5C.

Figure 1:
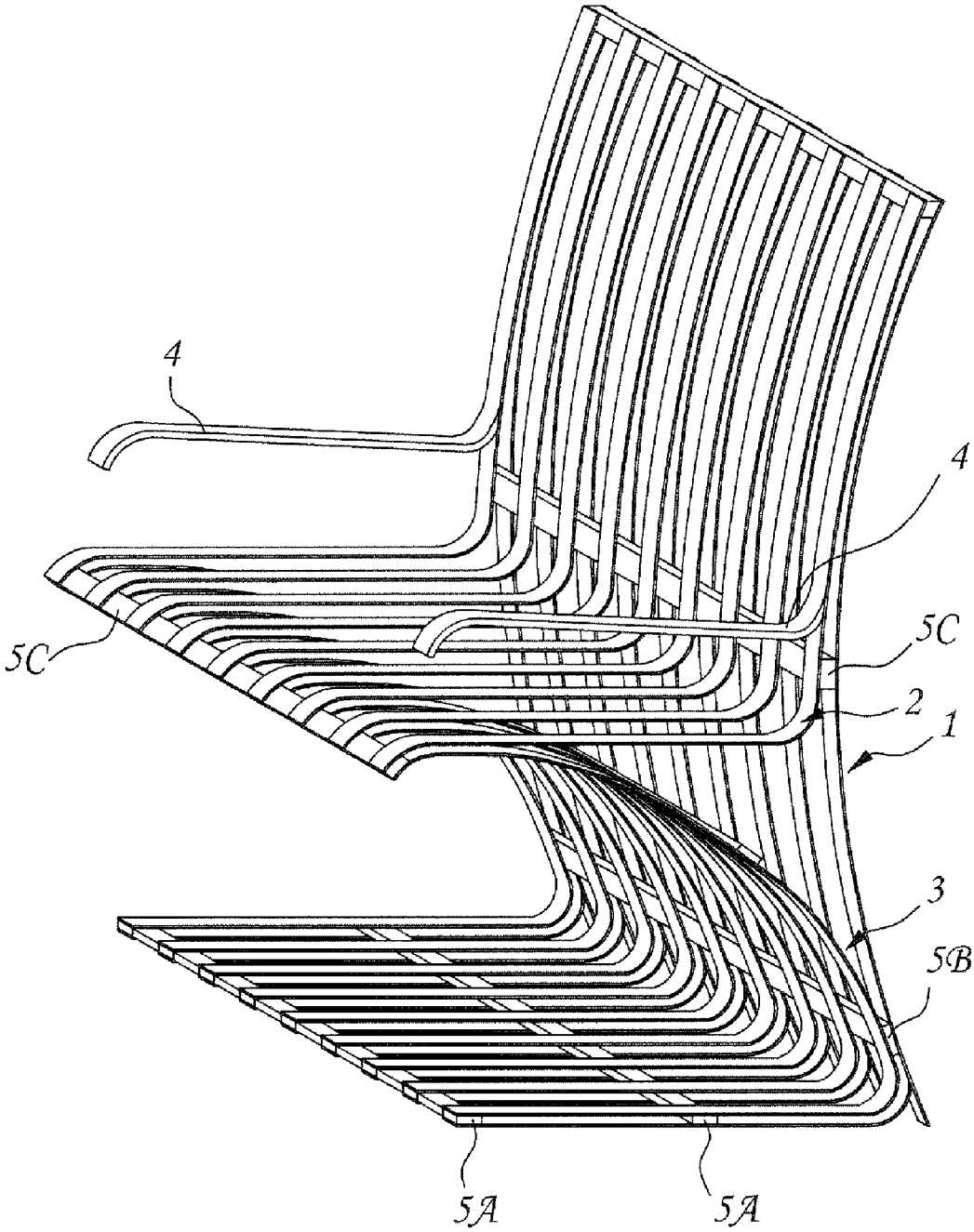
FIG. 1 is an oblique elevation of a bamboo cantilever chair with armrests in accordance with a first embodiment of the present invention.

FIG. 1 illustrates a bamboo chair in accordance with a second embodiment of the present invention. This second embodiment is substantially similar to the aforesaid first embodiment with the exception that this second embodiment further comprises two fourth bamboo strips 4 bilaterally affixed to the arched vertical sides 21 of the two outer second bamboo strips 2 of the cantilever chair to work as armrests for the resting of the user's two arms.

Figure 4:
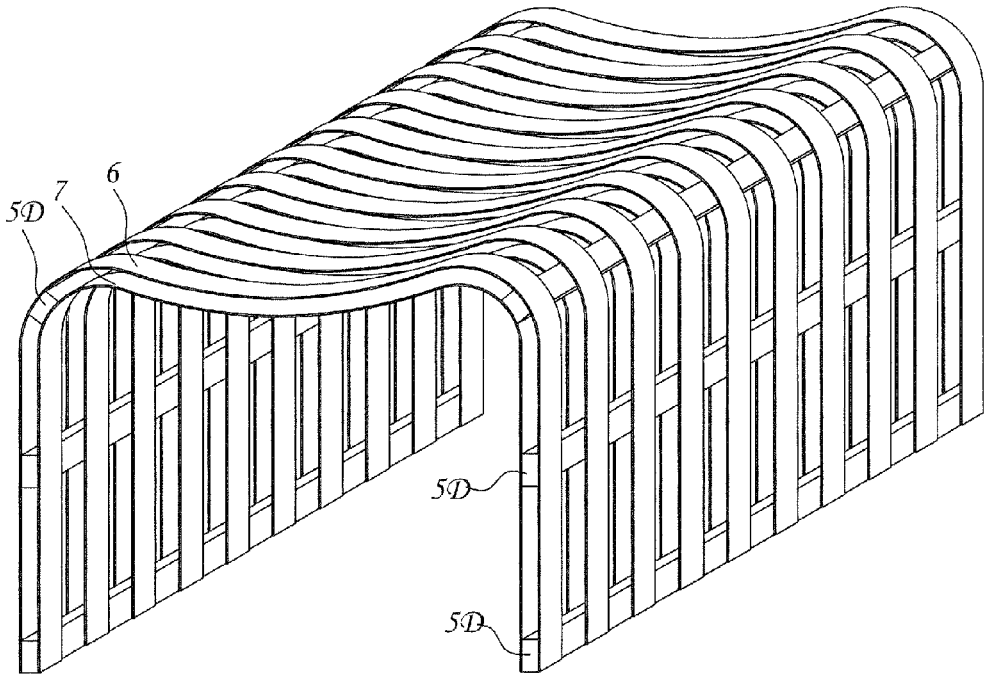
FIG. 4 is an oblique elevation of a bamboo chair in accordance with a third embodiment of the present invention.
Figure 5:
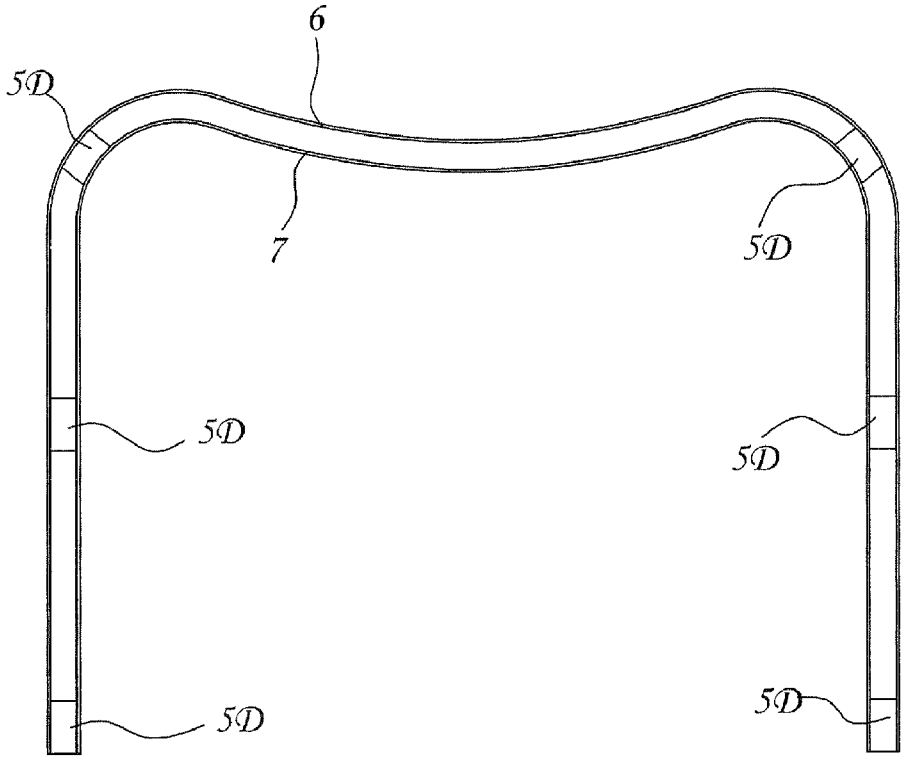
FIG. 5 is a side plain view of the bamboo chair shown in FIG. 4.

Referring to FIGS. 4 and 5, a bamboo chair in accordance with a third embodiment of the present invention is a cantilever chair made by connecting fifth bamboo strips 6, sixth bamboo strips 7 and a plurality of fourth reinforcing members 5D together. The fifth bamboo strips 6 and the sixth bamboo strips 7 are substantially ⊓-shaped. The size of the sixth bamboo strips 7 is slightly smaller than the size of the fifth bamboo strips 6 such that one sixth bamboo strip 7 can be attached to the inside of one fifth bamboo strip 6. During installation, the fifth bamboo strips 6 and the sixth bamboo strips 7 are respectively arranged, and the fourth reinforcing members 5D are fixedly mounted in between the fifth bamboo strips 6 and the sixth bamboo strips 7 and kept apart from one another.

Although particular embodiments of the invention have been described in detail for purposes of illustration, various modifications and enhancements may be made without departing from the spirit and scope of the invention. Accordingly, the invention is not to be limited except as by the appended claims.

I claim:

1. A bamboo chair, comprising:

a plurality of L-shaped first bamboo strips arranged in parallel, each said L-shaped first bamboo strip having an arched vertical side and a straight horizontal side;

a plurality of L-shaped second bamboo strips arranged in parallel, each said L-shaped second bamboo strip having an arched vertical side and a straight horizontal side, the straight horizontal sides of said L-shaped second bamboo strips being respectively suspended above the straight horizontal sides of said L-shaped first bamboo strips;

a plurality of first reinforcing members fixedly connected between the straight horizontal sides of said L-shaped third bamboo strips and the straight horizontal sides of said L-shaped first bamboo strips and arranged in parallel;

at least one second reinforcing member fixedly connected between the arched vertical sides of said L-shaped first bamboo strips and the arched vertical sides of said L-shaped first bamboo strips near the straight horizontal side of each said L-shaped third bamboo strip;

a plurality of L-shaped second bamboo strips arranged in parallel and supported between the arched vertical sides of said L-shaped first bamboo strips and the arched vertical sides of said L-shaped third bamboo strips, each said L-shaped second bamboo strip having an arched vertical side and a straight horizontal side;

a plurality of third reinforcing members respectively fixedly connected between the arched vertical sides of said L-shaped third bamboo strips and the straight horizontal sides of said L-shaped second bamboo strips and between the arched vertical sides of said L-shaped second bamboo strips and the arched vertical sides of said L-shaped first bamboo strips;

wherein said first reinforcing members, the straight horizontal sides of said L-shaped third bamboo strips and the straight horizontal sides of said L-shaped first bamboo strips constitute a base unit for positioning on the floor; the at least one second reinforcing member, the arched vertical sides of said L-shaped third bamboo strips and the arched vertical sides of said L-shaped first bamboo strips constitute a support unit; said third reinforcing members, the arched vertical sides of said L-shaped third bamboo strips and the straight horizontal sides of said L-shaped second bamboo strips constitute a seat unit supported on said support unit for the sitting of a person; the arched vertical sides of said L-shaped first bamboo strips, the arched vertical sides of said L-shaped third bamboo strips define a first open space; the arched vertical sides of said L-shaped third bamboo strips and the straight horizontal sides of said L-shaped second bamboo strips define a second open space in communication with said first open space for pressure buffering.

2. The bamboo chair as claimed in claim 1, wherein said first reinforcing members, said at least one second reinforcing member and said third reinforcing members are straight bamboo slats.

3. The bamboo chair as claimed in claim 1, further comprising two fourth bamboo strips affixed to two said L-shaped second bamboo strips at two opposite lateral sides for use as armrests for the resting of the two arms of a person sitting on said seat unit.

4. The bamboo chair as claimed in claim 1, wherein each said L-shaped first bamboo strip having a heel protruded from a bottom end of the arched vertical side adjacent to the straight horizontal side thereof.

* * * * *